US009865192B2

(12) United States Patent
Iida

(10) Patent No.: US 9,865,192 B2
(45) Date of Patent: Jan. 9, 2018

(54) VIDEO SIGNAL CONTROL METHOD AND VIDEO SIGNAL CONTROLLER FOR DISPLAY DEVICE

(71) Applicant: Yohei Iida, Tokyo (JP)

(72) Inventor: Yohei Iida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 68 days.

(21) Appl. No.: 14/763,785

(22) PCT Filed: Mar. 5, 2013

(86) PCT No.: PCT/JP2013/055963

§ 371 (c)(1),
(2) Date: Jul. 27, 2015

(87) PCT Pub. No.: WO2014/136205

PCT Pub. Date: Sep. 12, 2014

(65) Prior Publication Data

US 2015/0364071 A1 Dec. 17, 2015

(51) Int. Cl.
*G09G 5/10* (2006.01)
*G09G 3/20* (2006.01)

(52) U.S. Cl.
CPC ..... *G09G 3/2003* (2013.01); *G09G 3/20* (2013.01); *G09G 3/2044* (2013.01);
(Continued)

(58) Field of Classification Search
CPC ..... G09G 3/2003; G09G 3/20; G09G 3/2044; G09G 2320/0247; G09G 2320/04; G09G 2320/064
(Continued)

(56) References Cited

U.S. PATENT DOCUMENTS 7,027,021 B2 4/2006 Cho
7,847,771 B2 12/2010 Maruyama et al.
(Continued)

FOREIGN PATENT DOCUMENTS

AU 676419 B 3/1997
CN 101183520 A 5/2008
(Continued)

OTHER PUBLICATIONS

An Office Action; "Notification of Reason(s) for Refusal," issued by the Japanese Patent Office dated Oct. 20, 2015, which corresponds to Japanese Patent Application No. 2015-504040 and is related to U.S. Appl. No. 14/763,785; with English language partial translation.

(Continued)

*Primary Examiner* — Mark Regn
(74) *Attorney, Agent, or Firm* — Studebaker & Brackett PC

(57) ABSTRACT

The present invention has an object to provide a video signal control technique capable of suppressing deterioration in display quality of a display device in which FRC is employed. A video signal control method for display device according to the present invention includes: (a) acquiring coordinate information and time information in a display screen of a display device; (b) selecting, with reference to an LUT storing a plurality of FRC parameters, a FRC parameter corresponding to the coordinate information and the time information; and (c) outputting the selected FRC parameter as a FRC parameter for controlling red and blue pixels and a FRC parameter for controlling green pixels opposite in phase to the FRC parameter for controlling red and blue pixels.

6 Claims, 14 Drawing Sheets

(52) U.S. Cl.
CPC . *G09G 2320/0247* (2013.01); *G09G 2320/04* (2013.01); *G09G 2320/064* (2013.01); *G09G 2340/0435* (2013.01)

(58) Field of Classification Search
USPC ..... 345/691
See application file for complete search history.

(56) References Cited

U.S. PATENT DOCUMENTS

| | | | | |
|---|---|---|---|---|
| 7,982,702 | B2 | 7/2011 | Kamada et al. | |
| 8,009,181 | B2 | 8/2011 | Nakanishi | |
| 8,228,354 | B2 | 7/2012 | Yoshida et al. | |
| 8,355,032 | B2 | 1/2013 | Nose et al. | |
| 8,687,027 | B2 | 4/2014 | Nose et al. | |
| 2007/0057885 | A1* | 3/2007 | Kurumisawa | G09G 3/2003 345/89 |
| 2008/0111838 | A1 | 5/2008 | Nakanishi | |
| 2009/0184983 | A1 | 7/2009 | Nose et al. | |
| 2009/0278869 | A1 | 11/2009 | Oishi et al. | |
| 2012/0249603 | A1* | 10/2012 | Ban | G09G 3/3614 345/690 |
| 2013/0241963 | A1 | 9/2013 | Nose et al. | |
| 2013/0265345 | A1* | 10/2013 | Krig | G09G 3/36 345/690 |

FOREIGN PATENT DOCUMENTS

| | | | | |
|---|---|---|---|---|
| JP | 08-046806 | A | | 2/1996 |
| JP | 2001-034239 | A | | 2/2001 |
| JP | 2001-215938 | A | | 8/2001 |
| JP | 2001215938 | A | * | 8/2001 |
| JP | 2001-282190 | A | | 10/2001 |
| jp | 2002-215113 | A | | 7/2002 |
| JP | 2002-287715 | A | | 10/2002 |
| JP | 2003-005695 | A | | 1/2003 |
| JP | 2003-122312 | A | | 4/2003 |
| JP | 2003-302944 | A | | 10/2003 |
| JP | 2005-049885 | A | | 2/2005 |
| JP | 2005-070652 | A | | 3/2005 |
| JP | 2005-222327 | A | | 8/2005 |
| JP | 2005-266224 | A | | 9/2005 |
| JP | 2005-316211 | A | | 11/2005 |
| JP | 2007-178509 | A | | 7/2007 |
| JP | 2009-175237 | A | | 8/2009 |
| JP | 2009-186800 | A | | 8/2009 |
| WO | 2006/121188 | A1 | | 11/2006 |
| WO | 2008/081594 | A1 | | 7/2008 |

OTHER PUBLICATIONS

An Office Action; "Notification of Reason(s) for Refusal," issued by the Japanese Patent Office dated Mar. 1, 2016, which corresponds to Japanese Patent Application No. 2015-504040 and is related to U.S. Appl. No. 14/763,785; with English language partial translation.

An Office Action issued by the Chinese Patent Office dated Sep. 20, 2016, which corresponds to Chinese Patent Application No. 201380074310.1 and is related to U.S. Appl. No. 14/763,785; with English language translation.

International Search Report for application No. PCT/JP2013/055963 dated Apr. 9, 2013.

Notification of Transmittal of Translation of the International Preliminary Report on Patentability and Translation of Written Opinion of the International Searching Authority; PCT/JP2013/055963; dated Sep. 17, 2015.

* cited by examiner

3 LOWER-ORDER BITS (001) CASE 1

3 LOWER-ORDER BITS (010) CASE 1

FIG. 8

3 LOWER-ORDER BITS(011) CASE 1

| | 0 FRAME | 1 FRAME | 2 FRAME | 3 FRAME | 4 FRAME | 5 FRAME | 6 FRAME | 7 FRAME |
|---|---|---|---|---|---|---|---|---|
| INVENTED SCHEME | 2 1 0 0<br>1 2 1 2<br>0 0 1 2<br>2 1 2 1 | 2 1 0 1<br>2 2 1 0<br>1 0 1 2<br>0 1 2 2 | 0 2 1 1<br>2 2 1 0<br>1 1 2 0<br>0 1 2 2 | 0 2 1 1<br>2 0 2 1<br>1 1 2 0<br>1 2 0 2 | 1 2 1 2<br>0 0 2 1<br>2 1 2 1<br>1 2 0 0 | 1 0 2 2<br>0 1 2 1<br>2 2 0 1<br>1 2 1 0 | 1 0 2 2<br>1 1 0 2<br>2 2 0 1<br>2 0 1 1 | 2 1 2 0<br>1 1 0 2<br>0 2 1 2<br>2 0 1 1 |
| UNDERLYING SCHEME | 0 ■ 0 0<br>■ 0 ■ 0<br>0 0 ■ 0<br>0 ■ 0 ■ | 0 ■ 0 ■<br>0 0 ■ 0<br>■ 0 ■ 0<br>0 ■ 0 0 | 0 0 ■ ■<br>0 0 ■ 0<br>■ ■ 0 0<br>0 ■ 0 0 | 0 0 ■ ■<br>0 0 0 ■<br>■ ■ 0 0<br>■ 0 0 0 | ■ 0 ■ 0<br>0 0 0 ■<br>0 ■ 0 ■<br>■ 0 0 0 | ■ 0 0 0<br>0 ■ 0 ■<br>0 0 0 ■<br>■ 0 ■ 0 | ■ 0 0 0<br>■ ■ 0 0<br>0 0 0 ■<br>0 0 ■ ■ | 0 ■ 0 0<br>■ ■ 0 0<br>0 0 ■ 0<br>0 0 ■ ■ |

3 LOWER-ORDER BITS (100) CASE 2

3 LOWER-ORDER BITS(101) CASE 3

VIDEO SIGNAL CONTROL METHOD AND VIDEO SIGNAL CONTROLLER FOR DISPLAY DEVICE

TECHNICAL FIELD

The present invention relates to a control scheme for a frame rate control that is a display technique for display device.

BACKGROUND ART

Frame rate control (hereinafter referred to as "FRC") is a function of signal control ICs or liquid crystal driving driver ICs. The display devices (such as liquid crystal display devices) employing FRC are capable of expressing gray levels that are greater in number than the gray levels that can be physically displayed (see, for example, Patent Documents 1 and 2).

For example, the 2-bit extension FRC is employed in the liquid crystal display device capable of physically providing a 6-bit (64-gray-level) display, allowing for expression of gray levels corresponding to 8 bits (256 gray levels). This is achieved by adding (or thinning out) gray levels through the temporal dithering processing or spatial dithering processing or both, so that halftones are expressed by the afterimage effect. In general, the constituent members that are physically capable of displaying a large number of gray levels are expensive. Thus, in developing low-cost products, FRC and low-cost members are often used in combination, which is known as an effective scheme.

PRIOR ART DOCUMENTS

Patent Documents

Patent Document 1: Japanese Patent Application Laid-Open No. 2001-34239

Patent Document 2: Japanese Patent Application Laid-Open No. 2002-287715

SUMMARY OF INVENTION

Problems to be Solved by the Invention

In a case where FRC is employed, the display quality is likely to deteriorate due to luminance flicker and luminance irregularities in the screen resulting from visual recognition of the luminance change at the time of gray-level addition (or thinning out of gray levels). The luminance flicker and luminance irregularities are caused by the luminance change in picture elements during gray-level addition (or thinning out of gray levels) in the basic operation, and in theory, are impossible to eliminate completely. Thus, when FRC is employed, the luminance flicker and luminance irregularities need to be prevented from being recognized by a viewer. The two methods described below are generally known as the means for suppressing flicker.

According to the first method, the luminance difference per gray level is made smaller to reduce the amount of change in luminance, whereby such change in luminance becomes less perceptible. This can be easily achieved through the use of the driver IC physically displaying a large number of gray levels but unfortunately results in a cost increase. As another implementation method, the absolute amount of voltage applied onto liquid crystals is reduced, which can produce the similar effects but results in a decrease in the transmittance of liquid crystals, providing poor contrast.

According to the second method, the conditions of driving the liquid crystal display device are changed, so that the temporal change in luminance becomes less perceptible to humans. This is generally known as the double-speed driving that doubles the frame frequency. However, this scheme is likely to cause various problems including an increase in heat value resulting from increased power consumption and increased load applied onto circuit members, and furthermore, insufficient contrast resulting from insufficient pixel charging caused by a reduction in liquid-crystal-cell writing time.

In FRC, luminance irregularities are mainly caused by the spatial dithering processing and the visibility of such irregularities is proportional to the bit width extended in FRC. For example, the spatial dithering processing is generally performed on each block composed of 2 by 2 pixels for the 2-bit extension FRC, each block composed of 2 by 4 pixels for the 3-bit extension FRC, and each block composed of 4 by 4 pixels for the 4-bit extension FRC. Consequently, unevenness in the in-plane coordinates of picture elements subjected to luminance change in each block tends to increase with increasing number of bits, whereby such unevenness is more likely to be recognized by a viewer as luminance irregularities.

In employing FRC, a greater extension of bit width produces greater effects, and therefore, the effective use of FRC requires, along with bit width extension, means for suppressing flicker and luminance irregularities.

The present invention therefore has an object to provide a video signal control technique capable of suppressing deterioration in display quality of a display device in which FRC is employed.

Means to Solve the Problems

A video signal control method for display device according to the present invention includes: (a) acquiring coordinate information and time information in a display screen of a display device; (b) selecting, with reference to a look-up table storing a plurality of frame rate control parameters, a frame rate control parameter corresponding to the coordinate information and the time information; and (c) outputting the selected frame rate control parameter as a frame rate control parameter for controlling red and blue pixels and a frame rate control parameter for controlling green pixels opposite in phase to the frame rate control parameter for controlling red and blue pixels.

A video signal controller for display device according to the present invention includes: acquisition unit to acquire coordinate information and time information in a display screen of a display device; selection unit including a look-up table storing a plurality of frame rate control parameters, to select, with reference to the look-up table, a frame rate control parameter corresponding to the coordinate information and the time information; and outputting unit to output the selected frame rate control parameter as a frame rate control parameter for controlling red and blue pixels and a frame rate control parameter for controlling green pixels opposite in phase to the frame rate control parameter for controlling red and blue pixels.

Effects of the Invention

The video signal control method for display device according to the present invention includes: acquiring coordinate information and time information in a display screen of a display device; selecting, with reference to a look-up table storing a plurality of frame rate control parameters, a frame rate control parameter corresponding to the coordinate information and the time information; and outputting the selected frame rate control parameter as a frame rate control parameter for controlling red and blue pixels and a frame rate control parameter for controlling green pixels opposite in phase to the frame rate control parameter for controlling red and blue pixels.

For example, assume that the luminance is changed by 30 (cd/m$^2$) in a case where pixels in all of the colors in one picture element are subjected to the gray-level addition operation. In this case, the effects of the present invention can be obtained through the luminance of human eyes, i.e., the luminosity characteristics of [red:green:blue]=[0.3:0.6:0.1]. If the present invention is employed, the phase for the gray-level addition (or the gray-level subtraction) operation for green pixels is reversed, so that the gray levels in the respective picture elements are changed, during the FRC control, in accordance with three cases being the gray-level change only for red and blue pixels, the gray-level change only for green pixels, and the gray-level change for all pixels in one picture element. According to these cases, if only red and blue pixels are subjected to gray-level addition and the luminosity for the red color and the blue color is given as [0.3+0.1=0.4], the luminance change is obtained from 30×0.4=12, indicating that the luminance is changed by 12 (cd/m$^2$). If only green pixels are subjected to gray-level addition and the luminosity for the green color is given as [0.6], the luminance change is obtained from 30×0.6=18, indicating that the luminance is changed by 18 (cd/m$^2$).

The luminance change in the screen has traditionally been divided in two stages of [absence of luminance change: presence of luminance change]=[0:30] depending on the luminance change in units of picture elements. According to the present invention, meanwhile, the luminance in the screen is changed in four stages of [absence of luminance change:luminance change only in red and blue pixels:luminance change only in green pixels:luminance change in the entirety of one picture element]=[0:12:18:30].

In addition, the gray-level addition for green pixels is performed spatially and temporally in opposite phase to the gray-level addition for red pixels and blue pixels, so that the two cases of [absence of luminance change] and [luminance change in the entirety of one picture element] are mutually exclusive. These cases may not be applicable depending on conditions. Thus, the luminance in the display screen during the employment of the present invention are changed in accordance with three cases of (A) [absence of luminance change:luminance change only in red and blue pixels:luminance change only in green pixels]=[0:12:18], (B) [luminance change only in red and blue pixels:luminance change only in green pixels:luminance change in the entirety of one picture element]=[12:18:30], and (C) [luminance change only in red and blue pixels:luminance change only in green pixels]=[12:18], whereby the absolute amount of change in luminance can be suppressed as compared to the traditional cases. In addition, only green pixels are controlled in opposite phase, so that the picture elements that are subjected to the luminance change in the display screen are twice as many as those of the traditional cases, providing the effects of reducing the unevenness in luminance in the display screen.

Thus, the above-described effects of [suppressing the absolute amount of luminance change] allow the luminance flicker to become less visible, and the effects of [reducing the unevenness in luminance in the display screen] can reduce the visibility of luminance irregularities. Consequently, the deterioration in display quality of the display device in which FRC is employed can be suppressed.

The video signal controller for display device according to the present invention includes: acquisition unit to acquire coordinate information and time information in a display screen of a display device; selection unit including a look-up table storing a plurality of frame rate control parameters, to select, with reference to the look-up table, a frame rate control parameter corresponding to the coordinate information and the time information; outputting unit to output the selected frame rate control parameter as a frame rate control parameter for controlling red and blue pixels; and outputting unit to output the selected frame rate control parameter that has been reversed to be opposite in phase as a frame rate control parameter for controlling green pixels.

As compared to the FRC control performed only in units of picture elements, the video signal controller for display device according to the present invention can suppress the absolute value of the amount of change in luminance during the FRC operation, whereby the visibility of the luminance flicker can be reduced.

In addition, the gray-level addition (or subtraction) for green pixels is performed spatially and temporally in opposite phase to red pixels and blue pixels, so that the picture elements subjected to gray-level addition in the display screen are twice as many as those in a case where a single frame rate control parameter is used to control the pixels in all of the colors in the picture elements, resulting in elimination of unevenness in luminance distribution in the display screen.

Thus, the luminance flicker becomes less visible as a result of suppression of the amount of change in luminance and the luminance irregularities can be hardly recognized due to the elimination of unevenness in luminance distribution. This can suppress deterioration in display quality of the display device in which FRC is employed.

These and other objects, features, aspects and advantages of the present invention will become more apparent from the following detailed description of the present invention when taken in conjunction with the accompanying drawings.

BRIEF DESCRIPTION OF DRAWINGS

FIG. 8 A diagram describing an FRC operation for three lower-order bits of (011).

DESCRIPTION OF EMBODIMENTS

First Embodiment

Figure 1:
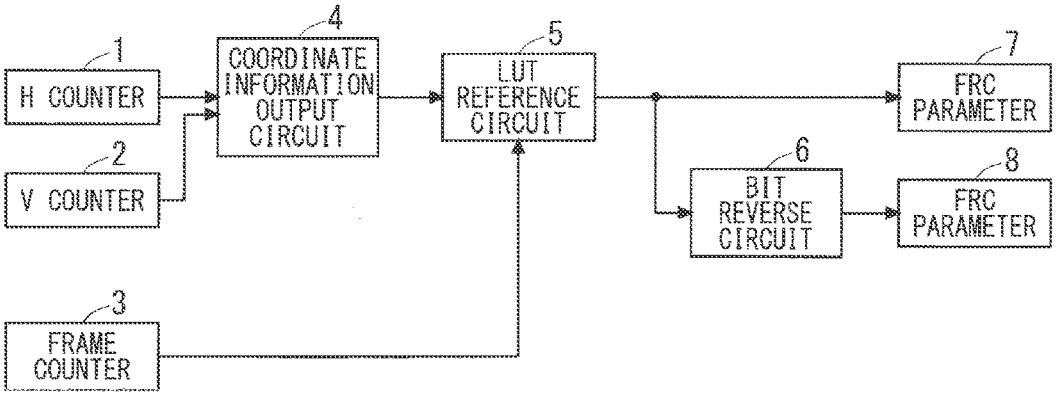
FIG. 1 A configuration diagram of a video signal controller for display device according to a first embodiment.

The following describes a first embodiment of the present invention with reference to the drawings. FIG. 1 is a configuration diagram of a video signal controller for display device according to the first embodiment and FIG. 2 is a schematic diagram of a look-up table (hereinafter referred to as "LUT") 5*a*.

Figure 2:
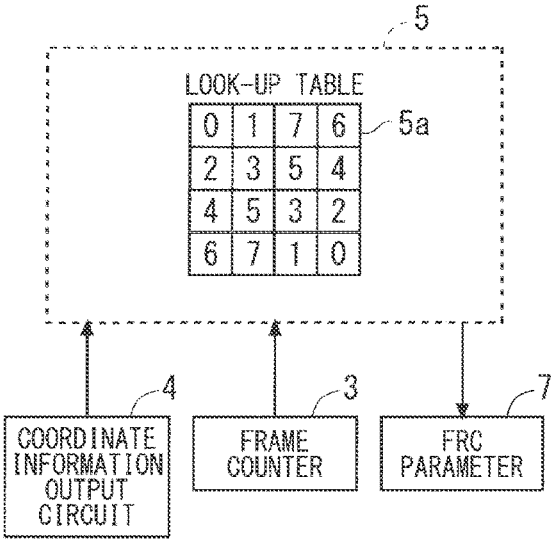
FIG. 2 A schematic diagram of a look-up table.

As shown in FIGS. 1 and 2, the video signal controller is embedded in, for example, a signal control IC or a liquid crystal driving driver IC to be incorporated into a liquid crystal display device (display device) (not shown) and includes an H counter 1, a V counter 2, a frame counter 3, a coordinate information output circuit 4, a look-up table reference circuit (hereinafter referred to as "LUT reference circuit") 5, and a bit reverse circuit 6.

The H counter 1 detects the horizontal coordinates in the display screen of the liquid crystal display device, and then, outputs the coordinates to the coordinate information output circuit 4. The V counter 2 detects the vertical coordinates in the display screen of the liquid crystal display device, and then, outputs the coordinates to the coordinate information output circuit 4. The frame counter 3 detects the time axis (time information) by detecting the number of frames of the video displayed on the display screen of the liquid crystal display device, and then, outputs the time axis (time information) to the LUT reference circuit 5.

The coordinate information output circuit 4 generates the coordinate information on the basis of the horizontal coordinates input by the H counter 1 and the vertical coordinates input by the V counter 2, and then, outputs the coordinate information to the LUT reference circuit 5. The LUT reference circuit 5 includes the LUT 5*a* and selects, with reference to the LUT 5*a*, a frame rate control parameter (hereinafter referred to as "FRC parameter") corresponding to the coordinate information input by the coordinate information output circuit 4 and the time information input by the frame counter 3, and then, outputs the frame rate control parameter. The LUT 5*a* stores, for example, a plurality of FRC parameters corresponding to various kinds of coordinate information and time information.

An FRC parameter 7 output by the LUT reference circuit 5 is output to the external part as the FRC parameter for controlling red and blue pixels and is also input into the bit reverse circuit 6. After undergoing the bit reverse in the bit reverse circuit 6, the FRC parameter 7 is output to the external part as the FRC parameter for controlling green pixels.

The H counter 1, the V counter 2, and the frame counter 3 are equivalent to the acquisition unit to acquire the coordinate information and the time information in the display screen of the display device. The LUT reference circuit 5 is equivalent to the selection unit including the LUT 5*a* storing a plurality of FRC parameters, to select the FRC parameter 7 corresponding to the coordinate information and the time information with reference to the LUT 5*a*. The LUT reference circuit 5 and the bit reverse circuit 6 are equivalent to the output unit to output the selected FRC parameter 7 as the FRC parameter for controlling red and blue pixels and the FRC parameter for controlling green pixels opposite in phase to the FRC parameter for controlling red and blue pixels.

Figure 3:
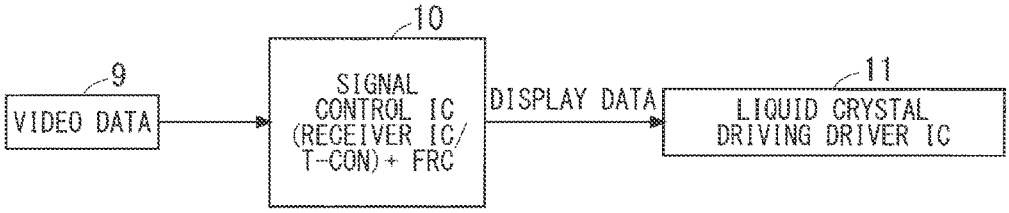
FIG. 3 A diagram showing an implementation form of a video signal control method.

The following describes an implementation form of a video signal control method for display device according to the first embodiment. FIG. 3 is a diagram showing the implementation form of the video signal control method. FIG. 3 shows a signal control IC 10 and a liquid crystal driving driver IC 11 that are incorporated in the liquid crystal display device. For example, a timing controller (T-CON) or a signal receiver IC is employed as the signal control IC 10. The signal control IC 10 has the FRC function. When video data 9 included in the video signal is input into the signal control IC 10, the FRC operation is performed in the signal control IC 10 and the display data is output to the liquid crystal driving driver IC 11, whereby the liquid crystal driving driver IC 11 is driven on the basis of the display data.

Figure 4:
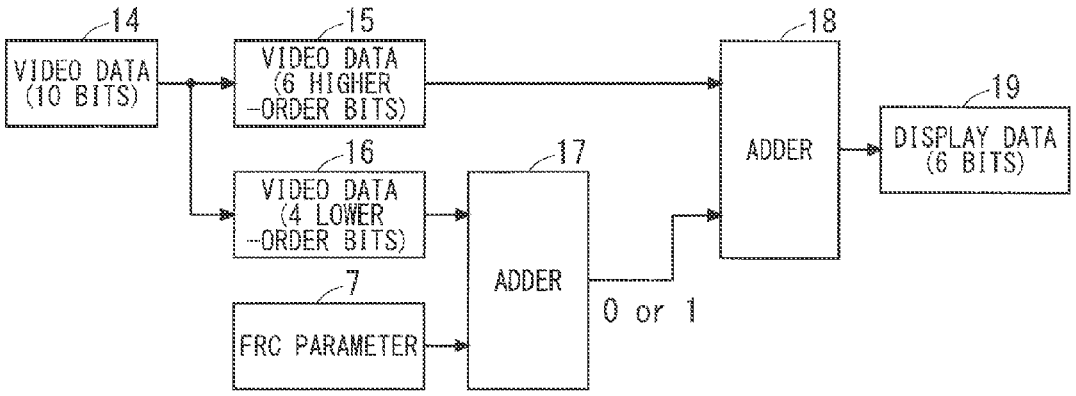
FIG. 4 A diagram describing a basic operation of FRC.

The following describes the basic operation of FRC executed by the signal control IC 10. FIG. 4 is a diagram describing the basic operation of FRC and shows an example of the basic configuration for providing the basic operation of FRC. The FRC operation is performed similarly for red pixels, blue pixels, and green pixels except that different FRC parameters are used, and thus, the following description is given with no distinction of pixel color.

Video data 14 is the 10-bit data, from which six higher-order bits are output to an adder 18 as video data 15 and four lower-order bits are output to an adder 17 as video data 16. One input terminal of the adder 17 receives the video data 16 and the other terminal of the adder 17 receives the FRC parameter 7 output from the device shown in FIG. 1, and then, the computation results are output to the adder 18. One input terminal of the adder 18 receives the video data 15 and the other input terminal of the adder 18 receives the computation results, and then, the computation results are output as 6-bit display data 19. In a case where the example of the basic configuration in FIG. 4 is adopted in the implementation form in FIG. 3, the video data 14 is input into the signal control IC 10 as the video data 9 and the display data 19 is input into the liquid crystal driving driver IC 11 as the display data.

Figure 5:
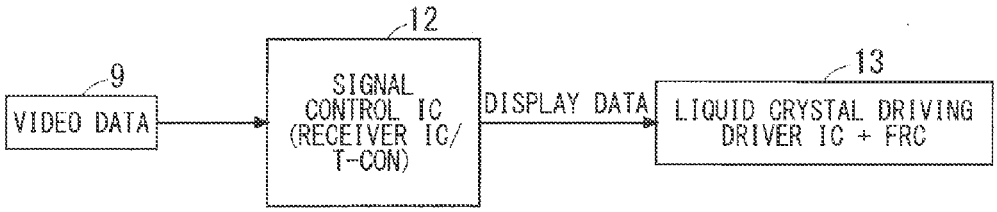
FIG. 5 A diagram showing another implementation form of the video signal control method.

FIG. 5 is a diagram showing another implementation form of the video signal control method. As shown in FIG. 5, the FRC function may be provided in a liquid crystal driving driver IC 13 instead of being provided in a signal control IC 12. In a case where the example of the basic configuration in FIG. 4 is adopted in the implementation form in FIG. 5, the video data 14 is input into the liquid crystal driving driver IC 13 as the display data, and then, the liquid crystal driving driver IC 13 is driven on the basis of the display data 19.

Figure 21:
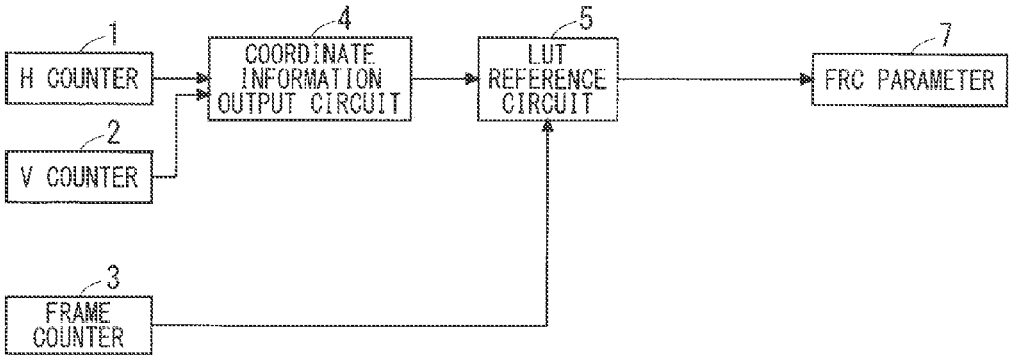
FIG. 21 A configuration diagram of the video signal controller for the display device according to an underlying technique.

The following describes the effects obtained by the video signal control method for display device according to the present embodiment by comparison with the video signal control method for display device according to the underlying technique. Firstly, the video signal control method for display device according to the underlying technique is described. FIG. 21 is a configuration diagram of the video signal controller for display device according to the underlying technique. The video signal controller does not includes the bit reverse circuit 6, and thus, the FRC parameter 7 selected by the LUT reference circuit 5 is, as it is, output to the external part. In the video signal control method for display device according to the underlying technique, the FRC parameter 7 is, as it is, used as the FRC parameter for controlling red, blue, and green pixels, to thereby control red, blue, and green pixels.

In the video signal control method according to the present embodiment, meanwhile, as shown in FIG. 1, the FRC parameter 7 output by the LUT reference circuit 5 is used, as the FRC parameter for controlling red and blue pixels, to control red and blue pixels, and an FRC parameter 8 obtained by reversing the bits of the FRC parameter 7 is used, as the FRC parameter for controlling green pixels, to control green pixels. Consequently, green pixels are controlled through spatial dithering and temporal dithering in opposite phase to red and blue pixels.

The following describes the luminance change after gray-level addition by comparison between the present embodiment and the underlying technique. FIGS. 6 to 12 are diagrams describing the FRC operation. The invented scheme (present embodiment) is indicated on the upper side and the underlying scheme (underlying technique) is indicated on the lower side of the paper plane in FIGS. 6 to 12. The 3-bit FRC is used as an example to facilitate the description, which not limited thereto.

FIGS. 6 to 12 show the FRC operation with the lapse of time by taking any one of 4 by 4 matrices of picture elements in the display screen as an example. FIGS. 6 to 12 illustrate the transition of the FRC operation in the display screen from the frame count of 0 to the frame count of 7 (the FRC operation for the 3-bit FRC is performed with eight frames as one cycle). In the matrices, 0 represents the absence of gray-level addition, 1 represents the gray-level addition only for red and blue pixels, 2 represents the gray-level addition only for green pixels, and 3 represents the gray-level addition for the entirety (red, green, and blue pixels) of one picture element.

In a case where the lower-order bits have smaller values, the picture elements subjected to gray-level addition in one cycle in the invented scheme are twice as many as in the underlying scheme. The reason therefore is given as follows. In the underlying scheme, the driving (gray-level addition) is performed only in units of picture elements. In the invented scheme, meanwhile, the driving of (gray-level addition for) red and blue pixels and the driving of (gray-level addition for) green pixels are performed separately by providing the FRC parameter 8 opposite in phase to the FRC parameter 7. In a case where the lower-order bits have larger values in the invented scheme, the driving of (gray-level addition for) red and blue pixels and the driving of (gray-level addition for) green pixels alone are performed, and in addition, the driving (gray-level addition) in units of picture elements is performed as the combination of the above. That is, the gray-level addition is performed for any one or some of the pixels in one picture element.

Thus, behavioral changes are observed in the invented scheme when compared to the underlying scheme. In particular, the luminance distribution in the display screen changes depending on conditions of the lower-order bits of the video data that is input, being broadly categorized into three types of cases (cases 1 to 3).

Figure 6:
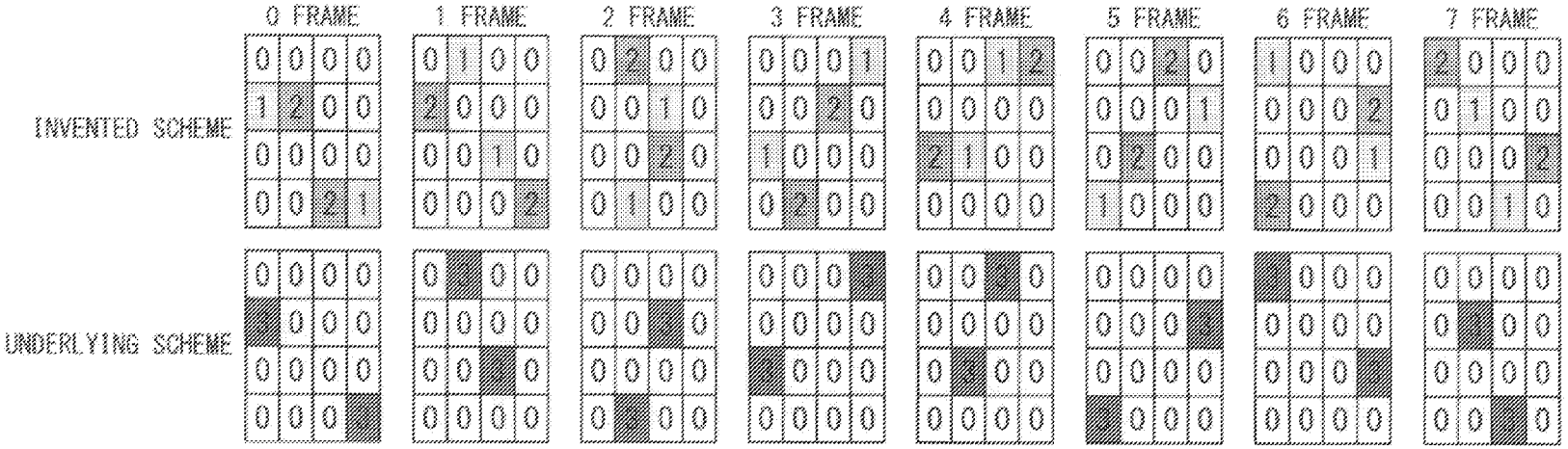
FIG. 6 A diagram describing an FRC operation for three lower-order bits of (001).
Figure 7:
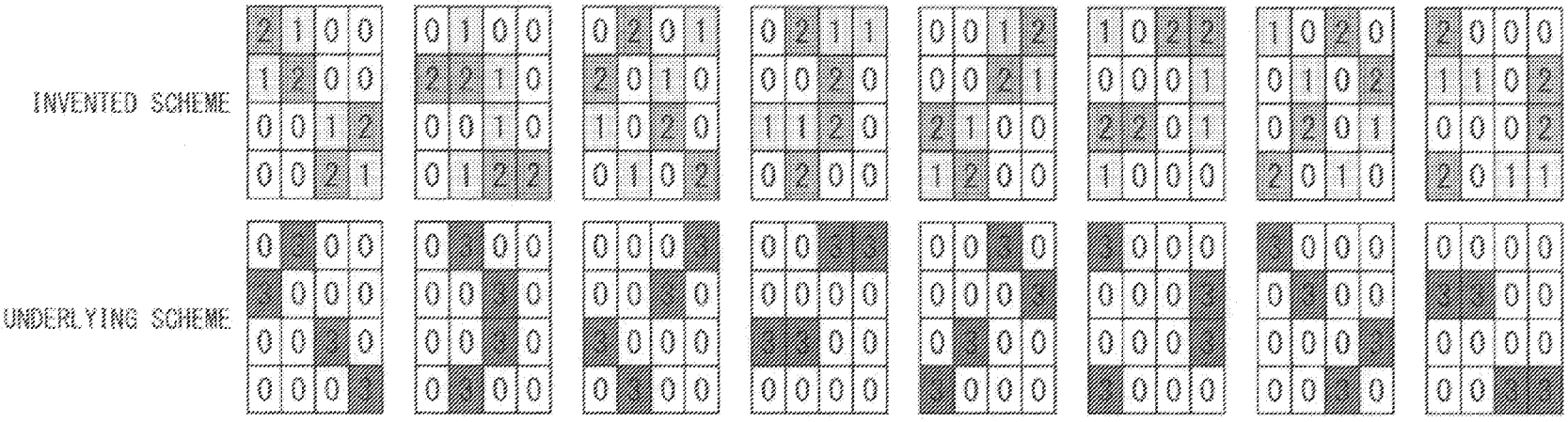
FIG. 7 A diagram describing an FRC operation for three lower-order bits of (010).
Figure 9:
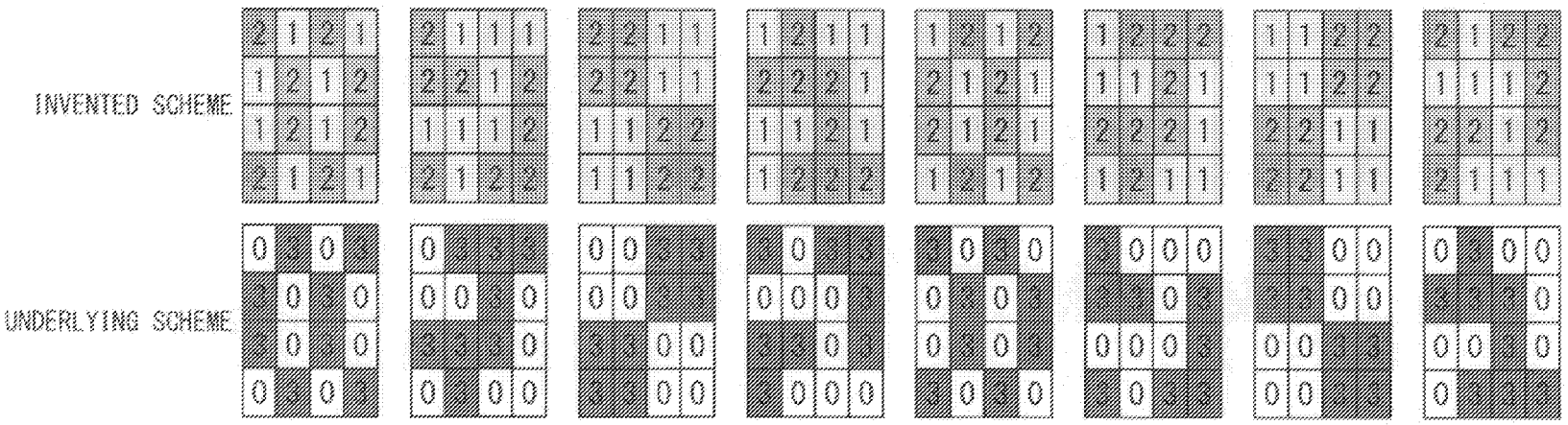
FIG. 9 A diagram describing an FRC operation for three lower-order bits of (100).
Figure 10:
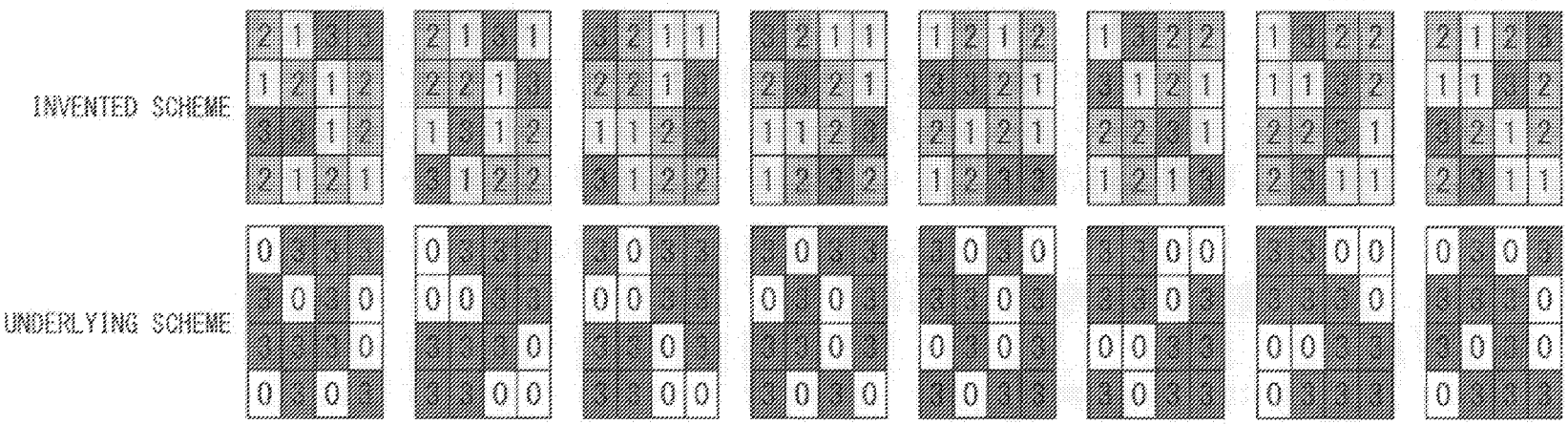
FIG. 10 A diagram describing an FRC operation for three lower-order bits of (101).
Figure 11:
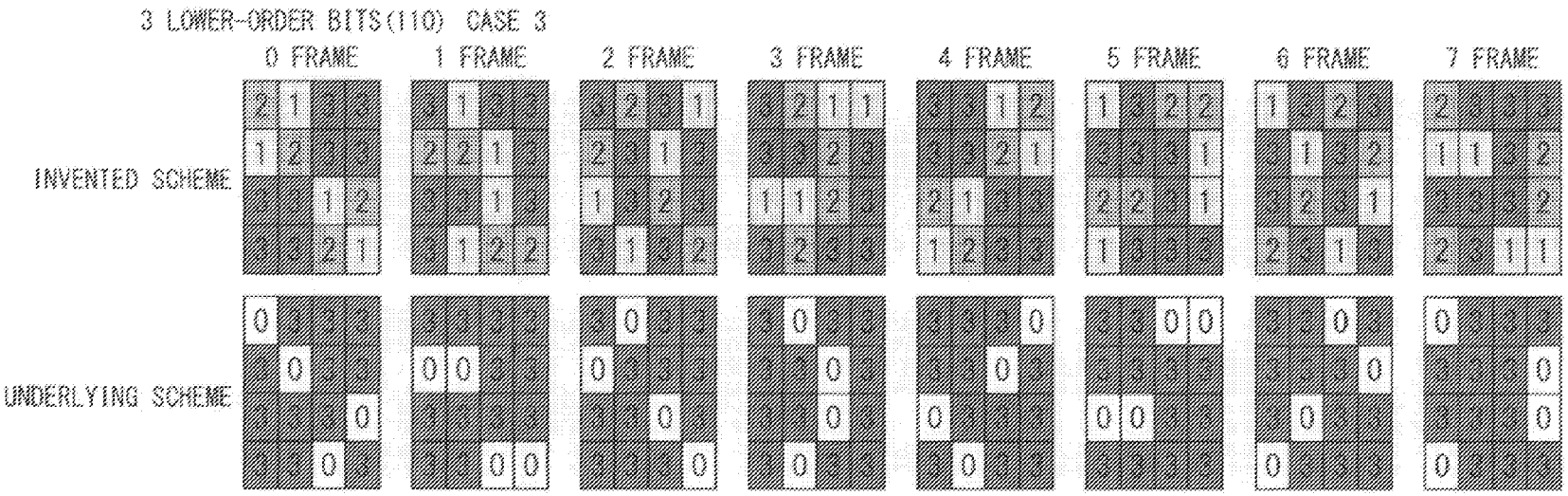
FIG. 11 A diagram describing an FRC operation for three lower-order bits of (110).
Figure 12:
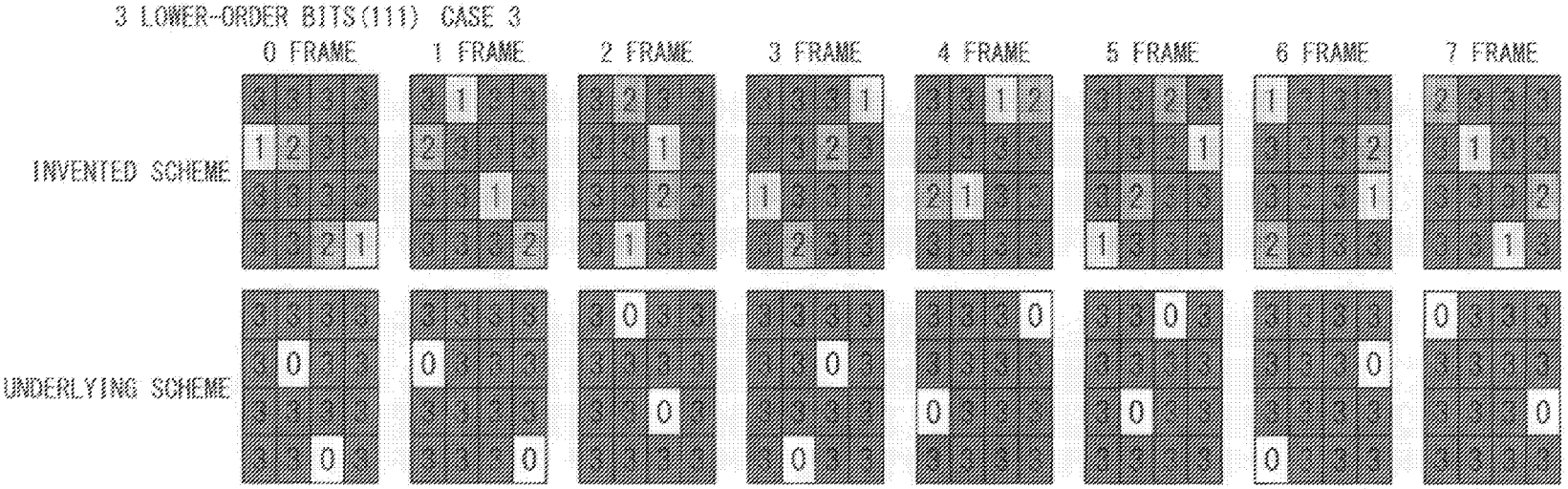
FIG. 12 A diagram describing an FRC operation for three lower-order bits of (111).

As shown in FIGS. 6 to 8, in the case 1 with the lower-order bits of (001 to 011), any one of three conditions being the gray-level addition only for red and blue pixels, the gray-level addition only for green pixels, and no gray-level addition for any of the pixels is provided. As shown in FIG. 9, in the case 2 with the lower-order bits of (100), either the gray-level addition only for red and blue pixels or the gray-level addition only for green pixels is provided. As shown in FIGS. 10 to 12, in the case 3 with the lower-order bits of (101 to 111), any one of three conditions being the gray-level addition only for red and blue pixels, the gray-level addition only for green pixels, and the gray-level addition for the entirety of one picture element is provided.

That is, according to the invented scheme, the values of the lower-order bits are categorized into three types being smaller, medium, and larger. If the values are smaller, some of the picture elements are not subjected to gray-level addition and no picture elements are subjected to gray-level addition for the entirety of one picture element. If the values are medium, pixels in any one or some of the colors in a picture element are all subjected to gray-level addition, there are no picture elements that are not subjected to gray-level addition, and no picture elements are subjected to gray-level addition for the entirety of one picture element. When the values are larger, there are no picture elements that are not subjected to gray-level addition.

For example, assume that the luminance is changed by 30 ($cd/m^2$) in a case where the entirety of one picture element is subjected to gray-level addition. The luminance for human eyes, i.e., the luminosity is given as [red:green:blue]=[0.3:0.6:0.1]. Thus, if only red and blue pixels are subjected to gray-level addition, the calculations of $0.3+0.1=0.4$ and $30\times0.4=12$ are made for the red color and blue color, Indicating that the luminance is changed by 12 ($cd/m^2$). If only green pixels are Subjected to gray-level addition and the luminosity for the green color is given as 0.6, the calculation of $30\times0.6=18$ is made, indicating that the luminance is changed by 18 ($cd/m^2$).

Thus, the luminance in the display screen for the case 1 (with the lower-order bits having a smaller value) is changed by 0, 12, or 18 ($cd/m^2$), indicating that the amount of change in luminance stands at 18. Similarly, for the case 2 (with the lower-order bits having a medium value), the luminance is changed by 12 or 18 ($cd/m^2$), indicating that the amount of change in luminance stands at 6. For the case 3 (with the lower-order bits having a larger value), the luminance change is changed by 12, 18, or 30 ($cd/m^2$), indicating that the amount of change in luminance stands at 18.

According to the underlying scheme, meanwhile, the luminance in the display screen is changed by 0 or 30 ($cd/m^2$), indicating that the amount of change in luminance stands at 30. Thus, the amount of change in luminance according to the invented scheme is suppressed to 20% (in the case 2) or 60% (in the case 1 and the case 3) of the amount of change in luminance according to the underlying scheme.

Figure 13:
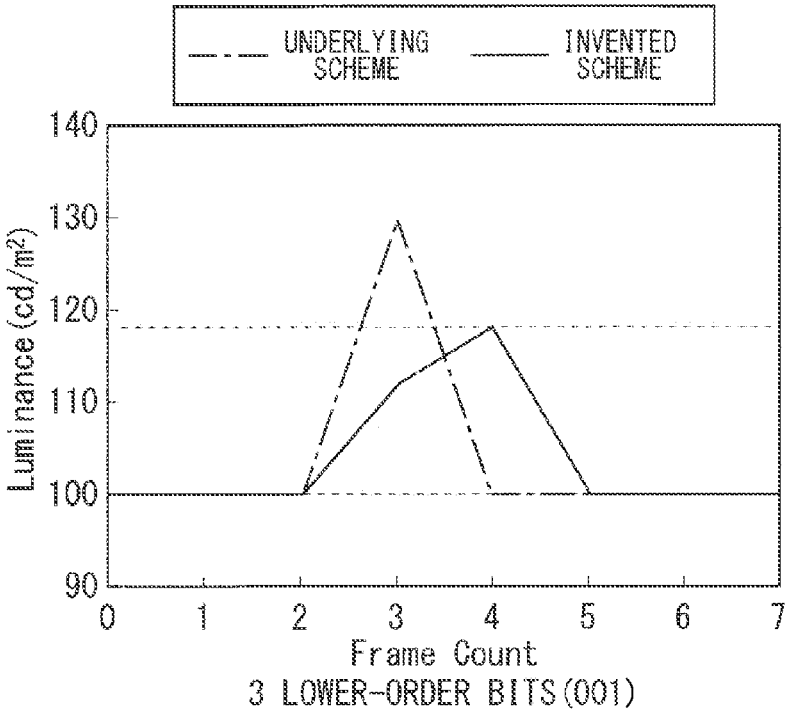
FIG. 13 A graph showing a luminance change for the three lower-order bits of (001).
Figure 14:
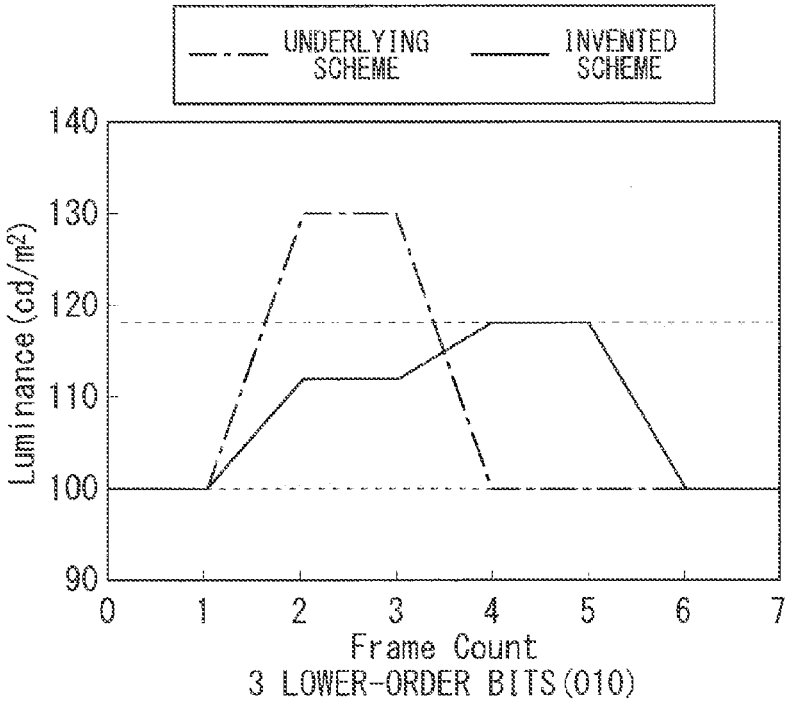
FIG. 14 A graph showing a luminance change for the three lower-order bits of (010).
Figure 15:
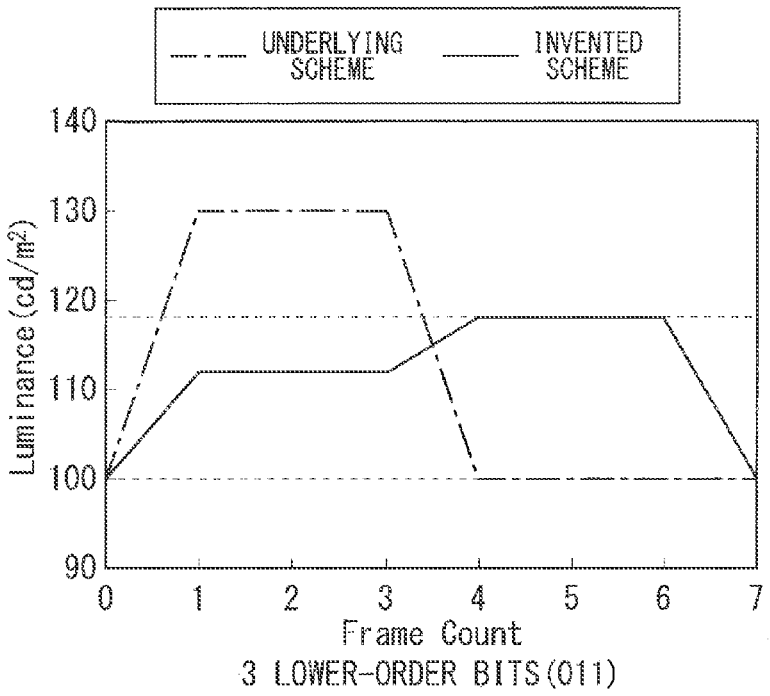
FIG. 15 A graph showing a luminance change for the three lower-order bits of (011).
Figure 16:
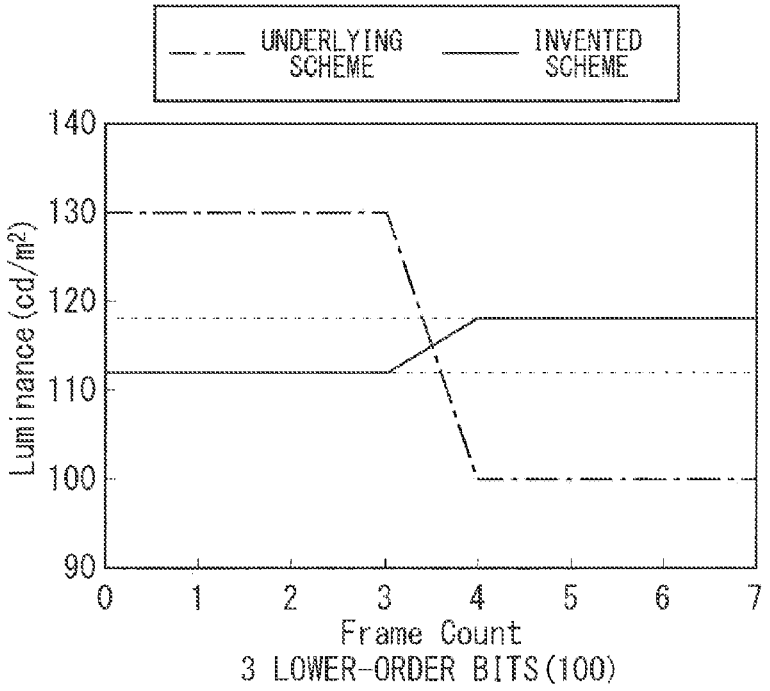
FIG. 16 A graph showing a luminance change for the three lower-order bits of (100).
Figure 17:
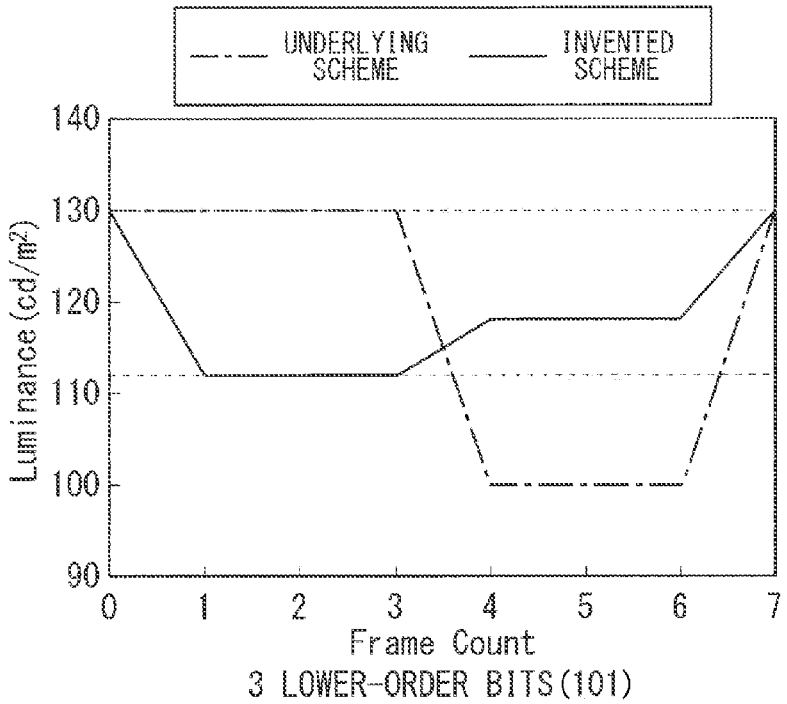
FIG. 17 A graph showing a luminance change for the three lower-order bits of (101).
Figure 18:
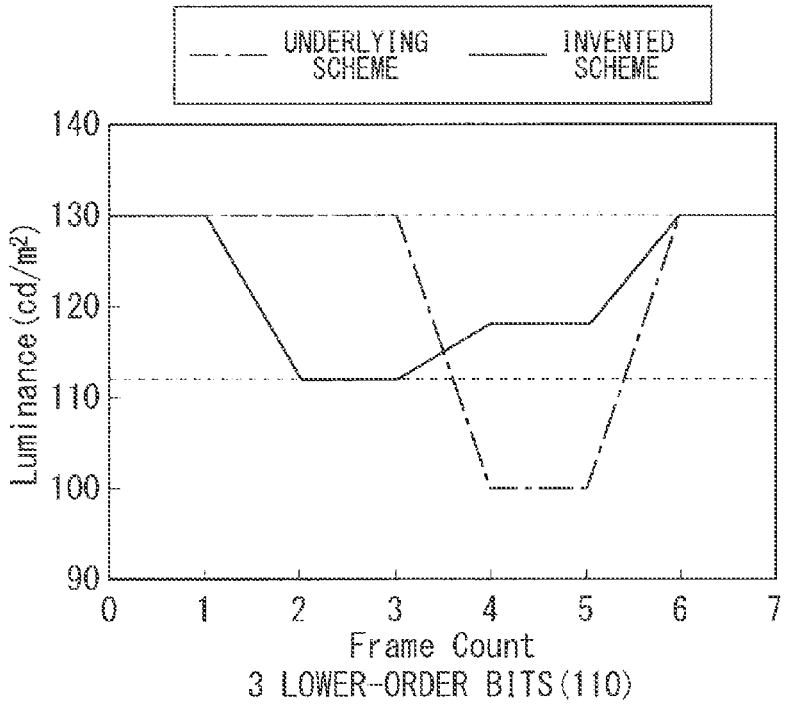
FIG. 18 A graph showing a luminance change for the three lower-order bits of (110).
Figure 19:
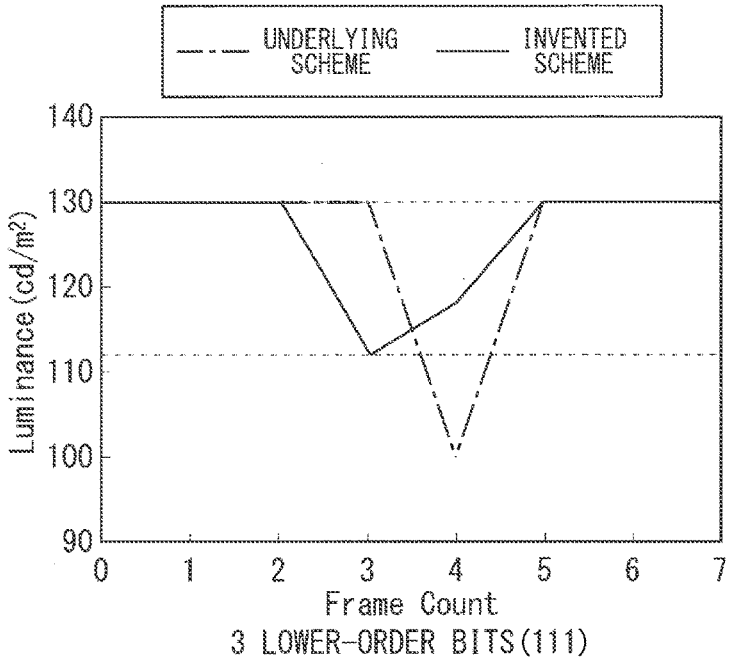
FIG. 19 A graph showing a luminance change for the three-order bits of (111).

The luminance change in the display screen is described with reference to the graphs. FIGS. 13 to 19 are graphs describing the luminance change in picture elements in the matrices according to the invented scheme and the underlying scheme shown in FIGS. 6 to 12. FIG. 13 is the graph for the three lower-order bits of (001), FIG. 14 is the graph for the three lower-order bits of (010), FIG. 15 is the graph for the three lower-order bits of (011), FIG. 16 is the graph for the three lower-order bits of (100), FIG. 17 is the graph for the three lower-order bits of (101), FIG. 18 is the graph for the three lower-order bits of (110), and FIG. 19 is the graph for the three lower-order bits of (111).

The axis of ordinates represents the luminance of picture element and the axis of abscissas represents the frame count (time axis). The luminance change in the picture element at the upper right of each matrix is shown as an example with alternate long and short dashed lines indicating the underlying scheme and a solid line indicating the invented scheme. In the graphs, the luminance in the case of no gray-level addition is set at 100 (cd/m$^2$), the luminance in the case of subjecting the entirety of one pixel to gray-level addition is set at 130 (cd/m$^2$), the luminance in the case of subjecting only red and blue pixels to gray-level addition is set at 112 (cd/m$^2$), and the luminance in the case of subjecting only green pixels to gray-level addition is set at 118 (cd/m$^2$). As shown in FIGS. 13 to 19, the invented scheme has the smaller amount of change in the luminance in picture elements than that of the underlying scheme.

The following describes the elimination of unevenness in luminance distribution in the display screen. With the increased number of bits extended through FRC, if fewer picture elements are subjected to luminance change, the unevenness is more likely to be recognized. According to the invented scheme, meanwhile, green pixels behave in opposite phase to red and blue pixels, so that the picture elements subjected to gray-level addition in the display screen are twice as many as those in the underlying scheme, eliminating the unevenness in luminance distribution in the display screen. Consequently, the luminance irregularities can be reduced.

Thus, the video signal control method through the video signal controller for display device according to the first embodiment includes: acquiring the coordinate information and the time information in the display screen of the display device; selecting, with reference to the LUT 5*a* storing a plurality of FRC parameters, the FRC parameter 7 corresponding to the coordinate information and the time information; and outputting the selected FRC parameter 7 as the FRC parameter for controlling red and blue pixels and the FRC parameter for controlling green pixels opposite in phase to the FRC parameter for controlling red and blue pixels.

Consequently, as described above, the amount of change in luminance in the display screen according to the first embodiment is suppressed to 20% (in the case 2) or 60% (in the case 1 and the case 3) of the amount of change in luminance according to the underlying technique, so that the difference in luminance in the display screen becomes less conspicuous.

In addition, the gray-level addition for green pixels is performed spatially and temporally in opposite phase to the gray-level addition for red pixels and blue pixels, so that the picture elements subjected to gray-level addition in the display screen are twice as many as those in a case where the same FRC parameter is used in the gray-level addition for pixels in all of the colors in the picture elements, resulting in elimination of the unevenness in luminance distribution in the display screen.

Thus, the luminance flicker becomes less visible as a result of suppression of the amount of change in luminance and the luminance irregularities can be hardly recognized due to the elimination of unevenness in luminance distribution. This can suppress deterioration in the display quality of the display device in which FRC is employed.

In the step of outputting the FRC parameter 7, one of the FRC parameter for controlling red and blue pixels and the FRC parameter for controlling green pixels is the FRC parameter 7 and the other is the FRC parameter 8 obtained by reversing the bits of the FRC parameter 7. The easy method of reversing the bits of the FRC parameter 7 allows for generation and outputting of the FRC parameter for controlling red and blue pixels and the FRC parameter for controlling green pixels in opposite phase, whereby an increase in the manufacturing cost of the display device can be suppressed.

According to the above description, the FRC parameter 8 intended for green pixels is generated by reversing the bits of the FRC parameter 7 intended for red and blue pixels. Alternatively, the FRC parameter 7 intended for red and blue pixels may be generated by outputting the FRC parameter 8 intended for green pixels from the LUT reference circuit 5 and reversing the bits of the FRC parameter 8.

In FIGS. 6 to 12, the pixels subjected to gray-level addition are dispersed through the simple phase reverse. Thus, in terms of temporal changes, the successive state of gray-level addition such as [11112222] is shown in, for example, the picture element at the upper right of the matrix for the lower-order bits of (100). However, the order of alignment is not limited to the above example, and thus, such order may be replaced by, for example, [12121212].

Second Embodiment

Figure 20:
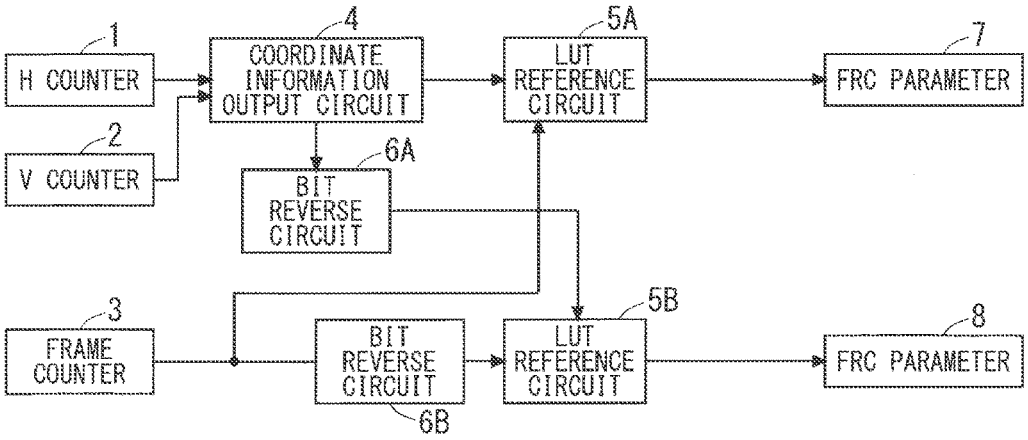
FIG. 20 A configuration diagram of the video signal controller for display device according to a second embodiment.

The following describes the video signal control method for display device according to a second embodiment. FIG. 20 is a configuration diagram of the video signal controller for display device according to the second embodiment. In the second embodiment, the same reference signs indicate the same constituent components described in the first embodiment, and description thereof is omitted.

Although the video signal controller according to the first embodiment includes the LUT reference circuit 5 and the bit reverse circuit 6, the video signal controller according to the second embodiment includes two bit reverse circuits being reverse circuits 6A and 6B and two LUT reference circuits being LUT reference circuits 5A and 5B. The coordinate information output by the coordinate information output circuit 4 is input into the LUT reference circuit 5A and is also input into the bit reverse circuit 6A. The time information output by the frame counter 3 is input into the LUT reference circuit 5A and is also input into the bit reverse circuit 6B. Then, the coordinate information and the time information whose bits have been reversed in the bit reverse circuits 6A and 6B are input into the LUT reference circuit 5B.

The LUT reference circuit 5A includes an LUT (first LUT) and selects, with reference to the LUT, the FRC parameter 7 corresponding to the coordinate information input by the coordinate information output circuit 4 and the time information input by the frame counter 3, and then, outputs the FRC parameter 7. The LUT reference circuit 5B includes an LUT (second LUT) and selects, with reference to the LUT, the FRC parameter 8 corresponding to the coordinate information and the time information whose bits have been reversed in the bit reverse circuits 6A and 6B.

The bit reverse circuits 6A and 6B are equivalent to first and second bit reverse circuits, respectively. The LUT reference circuits 5A and 5B are equivalent to first and second selection units, respectively, and are also equivalent to the output unit.

Thus, in the step of selecting the FRC parameter 7 in the video signal control method through the video signal controller for display device according to the second embodiment, the FRC parameter 7 selected in accordance with the coordinate information and the time information is one of the FRC parameter for controlling red and blue pixels and the FRC parameter for controlling green pixels, and the FRC parameter 8 selected in accordance with the coordinate information and the time information whose bits have been reversed is the other. The easy method of reversing the bits of the coordinate information and the time information allows for generation and outputting of the FRC parameter for controlling red and blue pixels and the FRC parameter for controlling green pixels in opposite phase, whereby an increase in the manufacturing cost of the display device can be suppressed.

While the invention has been shown and described in detail, the foregoing description is in all aspects illustrative and not restrictive. It is therefore understood that numerous modifications and variations can be devised without departing from the scope of the invention.

In the present invention, the above preferred embodiments can be arbitrarily combined, or each preferred embodiment can be appropriately varied or omitted within the scope of the invention.

EXPLANATION OF REFERENCE SIGNS

1 H counter, 2 V counter, 3 frame counter, 5, 5A, 5B LUT reference circuit, 5*a* LUT, 6, 6A, 6B bit reverse circuit, 7, 8 FRC parameter.

The invention claimed is:

1. A video signal control method for display device, said method comprising:

(a) acquiring coordinate information and time information in a display screen of a display device;

(b) selecting, with reference to a look-up table storing a plurality of frame rate control parameters, a frame rate control parameter corresponding to said coordinate information and said time information; and (c) outputting said selected frame rate control parameter as a frame rate control parameter for controlling red and blue pixels to have a same phase and a frame rate control parameter for controlling green pixels opposite in phase to the same phase of the frame rate control parameter for controlling red and blue pixels, wherein said selected frame rate control parameter depends on the number of frames to be displayed.

2. The video signal control method for display device according to claim 1, wherein in said (c), one of said frame rate control parameter for controlling red and blue pixels and said frame rate control parameter for controlling green pixels is said frame rate control parameter selected in said (b), and the other is obtained by reversing bits of the frame rate control parameter.

3. The video signal control method for display device according to claim 1, wherein in said (b), the frame rate control parameter selected in accordance with said coordinate information and said time information is one of said frame rate control parameter for controlling red and blue pixels and said frame rate control parameter for controlling green pixels, and a frame rate control parameter selected in accordance with said coordinate information and said time information whose bits have been reversed is the other.

4. A video signal controller for display device, comprising:

an acquisition unit to acquire coordinate information and time information in a display screen of a display device;

a selection unit including a look-up table storing a plurality of frame rate control parameters, to select, with reference to the look-up table, a frame rate control parameter corresponding to said coordinate information and said time information; and an outputting unit to output said selected frame rate control parameter as a frame rate control parameter for controlling red and blue pixels to have a same phase and a frame rate control parameter for controlling green pixels opposite in phase to the same phase of the frame rate control parameter for controlling red and blue pixels, wherein said selected frame rate control parameter depends on the number of frames to be displayed.

5. The video signal controller for display device according to claim 4, wherein said outputting unit includes a bit reverse circuit that reverses bits of said frame rate control parameter, one of said frame rate control parameter for controlling red and blue pixels and said frame rate control parameter for controlling green pixels is said frame rate control parameter selected by said selection unit, and the other is obtained by reversing bits of the frame rate control parameter in said bit reverse circuit.

6. The video signal controller for display device according to claim 4, further comprising a first bit reverse circuit that reverses bits of said coordinate information and a second bit reverse circuit that reverses bits of said time information, wherein said selection unit includes:

first selection unit including a first look-up table storing a plurality of frame rate control parameters, to select, with reference to the first look-up table, a frame rate control parameter corresponding to said coordinate information and said time information; and second selection unit including a second look-up table storing a plurality of frame rate control parameters, to select, with reference to the second look-up table, a frame rate control parameter corresponding to the coordinate information and the time information whose bits have been reversed in said first and second bit reverse circuits, and the frame rate control parameter selected in accordance with said coordinate information and said time information is one of said frame rate control parameter for controlling red and blue pixels and said frame rate control parameter for controlling green pixels, and the frame rate control parameter selected in accordance with said coordinate information and said time information whose bits have been reversed is the other.

* * * * *